US007291963B2

(12) United States Patent
Haraguchi

(10) Patent No.: US 7,291,963 B2
(45) Date of Patent: Nov. 6, 2007

(54) IMAGE DISPLAY DEVICE

(75) Inventor: Yuuji Haraguchi, Hiratsuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/512,350

(22) Filed: Aug. 30, 2006

(65) Prior Publication Data

US 2006/0284545 A1 Dec. 21, 2006

Related U.S. Application Data

(63) Continuation of application No. PCT/JP2005/004210, filed on Mar. 10, 2005.

(30) Foreign Application Priority Data

Mar. 19, 2004 (JP) ..... 2004-080899

(51) Int. Cl.
*H01J 29/10* (2006.01)

(52) U.S. Cl. ..... 313/473; 313/461; 313/496

(58) Field of Classification Search ..... 313/461, 313/466, 473, 495, 496
See application file for complete search history.

(56) References Cited

U.S. PATENT DOCUMENTS

| | | | |
|---|---|---|---|
| 5,936,342 | A | 8/1999 | Ono et al. |
| 6,677,706 | B1 | 1/2004 | Hara et al. |
| 2004/0195958 | A1 | 10/2004 | Ito et al. |

FOREIGN PATENT DOCUMENTS

| | | | |
|---|---|---|---|
| JP | 9-82245 | A | 3/1997 |
| JP | 10-326583 | A | 12/1998 |
| JP | 2002-343241 | A | 11/2002 |
| JP | 2003-68237 | A | 3/2003 |
| JP | 2003-229074 | A | 8/2003 |
| JP | 2004-63202 | A | 2/2004 |

*Primary Examiner*—Vip Patel
(74) *Attorney, Agent, or Firm*—Oblon, Spivak, McClelland, Maier & Neustadt, P.C.

(57) ABSTRACT

A front substrate is provided which has a phosphor screen including a phosphor layer and a black light-blocking layer, a metal back layer which is laid over the phosphor screen and is composed of a plurality of strip-shaped divisional electrodes, a getter layer which is laid over the metal back layer, and a dividing layer which electrically divides the getter layer over the black light-blocking layer. The dividing layer has electrical conductivity.

7 Claims, 3 Drawing Sheets

IMAGE DISPLAY DEVICE

CROSS-REFERENCE TO RELATED APPLICATIONS

This is a Continuation Application of PCT Application No. PCT/JP2005/004210, filed Mar. 10, 2005, which was published under PCT Article 21(2) in Japanese.

This application is based upon and claims the benefit of priority from prior Japanese Patent Application No. 2004-080899, filed Mar. 19, 2004, the entire contents of which are incorporated herein by reference.

BACKGROUND OF THE INVENTION

1. Field of the Invention

The present invention relates to an image display device, and more particularly to an image display device wherein an electron source and a phosphor screen, which forms an image by irradiation of an electron beam emitted from the electron source, are included in a vacuum envelope.

2. Description of the Related Art

In general, in an image display device wherein an electron beam which is emitted from an electron source is radiated on a phosphor body, thereby causing the phosphor body to emit light and displaying an image, a vacuum envelope accommodates the electron source and the phosphor body. A gas occurring within the vacuum envelope increases pressure within the envelope. Consequently, the amount of electrons from the electron source decreases and high-luminance image display may be disabled. It is thus necessary to maintain the inside of the vacuum envelope at a high vacuum level.

In addition, the gas occurring in the vacuum envelope may be ionized by the electron beam, and the generated ions may be accelerated by an electric field. The accelerated ions may strike and damage the electron source.

In a conventional color cathode-ray tube (CRT), a getter material, which is provided in the vacuum envelope, is activated after sealing, and a gas that is emitted from, e.g. an inner wall at the time of operation is adsorbed on the getter material. Thereby, a desired vacuum level is maintained. Attempts have been made to apply such a vacuum level increase and vacuum level maintenance by the getter material to flat-screen image display devices.

In a flat-screen image display device, use is made of an electron source which is configured such that a great number of electron emitter elements are disposed on a planar substrate. Although the volume of the inside of the vacuum envelope is greatly reduced, compared to the ordinary CRT, the area of wall surfaces, from which gas is emitted, does not decrease. As a result, if the same amount of gas as in the CRT is emitted, the pressure within the vacuum envelope would greatly increase. Therefore, the role of the getter material in the flat-screen image display device is very important.

In recent years, studies have been made of forming a getter material in an image display region. Jpn. Pat. Appln. KOKAI Publication No. 9-82245, for instance, discloses a structure of a flat-screen image display device wherein a thin film of an electrically conductive getter material, such as titanium (Ti) or zirconium (Zr), is laid over a metal layer, i.e. a metal back layer, which is formed on a phosphor layer, or the metal back layer itself is formed of the electrically conductive getter material.

The objects of the metal back layer are to reflect, toward the face plate (front substrate) side, that component of light emitted from the phosphor body by electrons produced from the electron source, which travels toward the electron source side, thereby increasing luminance, to impart electrical conductivity to the phosphor layer and thus function as an anode electrode, and to prevent the phosphor layer from being damaged by ions produced by ionization of the gas remaining in the vacuum envelope.

In a conventional field emission display (FED), a very arrow gap of about 1 to several mm is provided between a face plate (front substrate) having a phosphor screen and a rear plate (back substrate) having electron emitter elements. A high voltage of about 10 kV is applied to this narrow gap, and an intense electric field is generated. Hence, there arises such a problem that discharge (vacuum arc discharge) easily occurs if an image is formed for a long time. If such abnormal discharge occurs, a discharge current of several A to several-hundred A flows instantaneously. Consequently, the electron emitter elements of the cathode section, the phosphor screen of the anode section, driving circuits, etc. may be destroyed or damaged (hereinafter referred to as "damage due to discharge").

Recently, in order to alleviate the damage due to discharge, it has been proposed that gaps are provided in a metal back layer that is used as the anode electrode. In order to more suppress the damage due to discharge, it has been required to provide gaps in a getter film that is an electrically conductive thin film coated on the metal back layer, for example, by forming the getter film with a predetermined pattern.

As a method of forming a getter layer with a predetermined pattern, there is known a conventional method in which a mask having a proper opening pattern is placed on a metal back layer, and film formation is performed by vacuum evaporation or sputtering. In this method, however, there are limitations to the precision of patterning or to the fineness of the pattern. There is a problem that the effect of suppressing damage due to discharge is inadequate.

On the other hand, there is a method in which a dividing layer with such characteristics as to electrically divide the getter layer is disposed in advance on the phosphor screen, and the getter layer is formed and divided at the same time. The dividing layer divides the getter layer into many insular parts so that a plurality of divisional electrodes that form a metal back layer may not electrically be connected by the getter layer that is an electrically conductive film. Taking the getter layer dividing function into account, it has been thought that the dividing layer should preferably be electrically insulative.

However, as has recently become clear, when an image is to be displayed, the insulating properties of the dividing layer adversely affect withstand voltage characteristics. Electrons from the electron emitter elements are emitted toward the phosphor screen. The electrons from the electron emitter elements are made incident on the phosphor layer, and do not directly enter the dividing layer. However, dispersed electrons from the phosphor layer enter the dividing layer. If the dividing layer is electrically insulative, the dividing layer is charged with the dispersed electrons, and slight partial discharge, which leads to discharge between the substrates, may occur. It is possible that the partial discharge frequently occurs at the time of image display, and deterioration in withstand voltage characteristics may lead to degradation in image quality.

BRIEF SUMMARY OF THE INVENTION

The present invention has been made in consideration of the above-described problems, and the object of the invention is to provide an image display device which can suppress damage due to discharge, and improve withstand voltage characteristics and display performance.

According to an aspect of the invention, there is provided an image display device comprising:

a front substrate having a phosphor screen which includes a phosphor layer and a light-blocking layer, a metal back layer which is laid over the phosphor screen and is composed of a plurality of strip-shaped divisional electrodes, an electrically conductive thin film which is laid over the metal back layer, and a dividing layer which electrically divides the electrically conductive thin film over the light-blocking layer; and a back substrate which is disposed to be opposed to the front substrate and is provided with electron emitter elements which emit electrons toward the phosphor screen, wherein the dividing layer has electrical conductivity. This image display device includes a dividing layer for electrically dividing an electrically conductive thin film. By imparting electrical conductivity to the dividing layer, it becomes possible to prevent the dividing layer from being charged even if dispersed electrons enter the dividing layer. Thus, the occurrence of discharge due to charging of the dividing layer can be suppressed, and the withstand characteristics can be improved. Therefore, the present invention can provide an image display device which can suppress damage due to discharge, and improve withstand voltage characteristics and display performance.

DETAILED DESCRIPTION OF THE INVENTION

An image display device according to an embodiment of the present invention will now be described with reference to the accompanying drawings. An FED having surface-conduction electron emitter elements is described as an example of the image display device.

Figure 1:
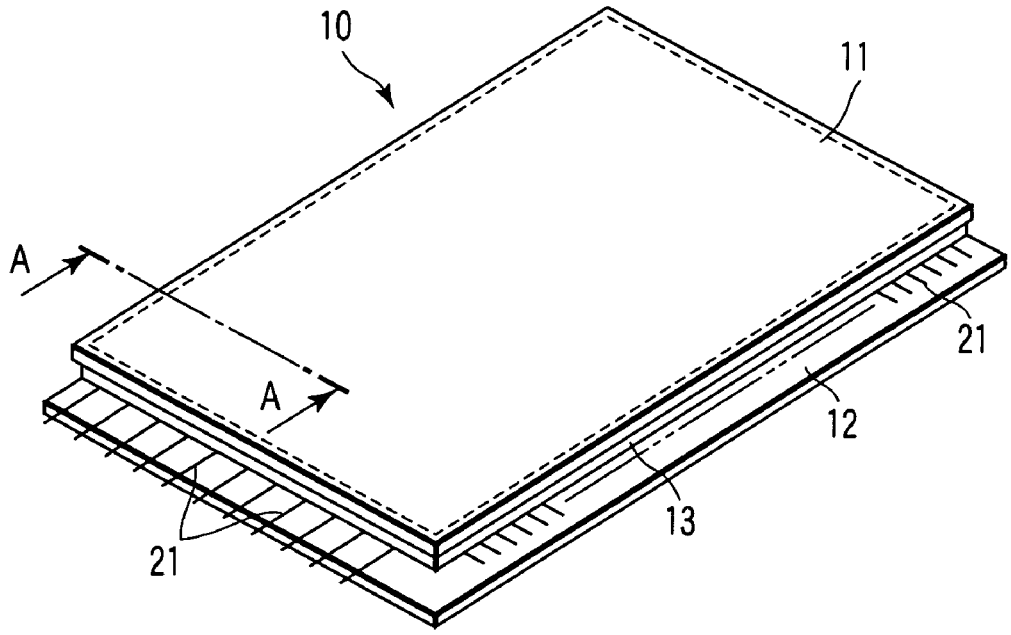
FIG. 1 is a perspective view that schematically shows an example of an FED which is manufactured by a manufacturing method and a manufacturing apparatus according to an embodiment of the present invention.
Figure 2:
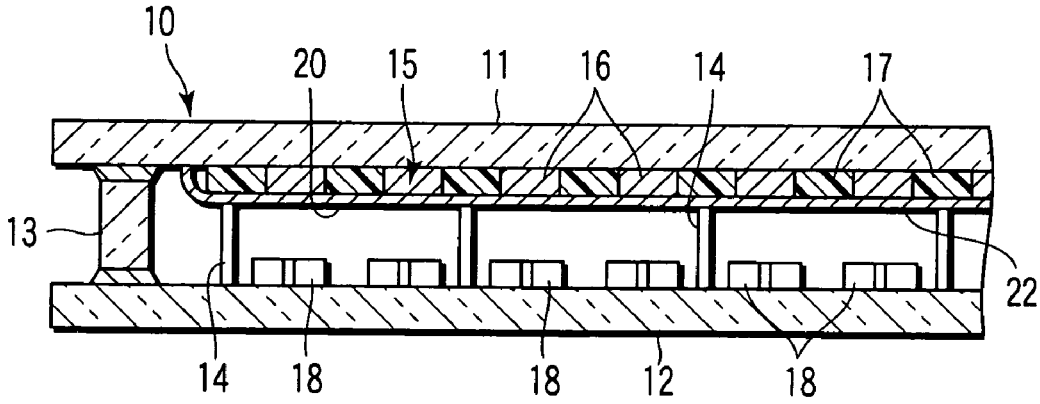
FIG. 2 is a cross-sectional view taken along line A-A in FIG. 1, and schematically shows a cross-sectional structure of the FED.

As is shown in FIG. 1 and FIG. 2, the FED includes a front substrate 11 and a back substrate 12, which are disposed to be opposed to each other with a gap of 1 to 2 mm. Each of the front substrate 11 and back substrate 12 is formed of a rectangular glass plate, which is an insulating substrate with a thickness of about 1 to 3 mm. Peripheral edge parts of the front substrate 11 and back substrate 12 are attached via a rectangular-frame-shaped side wall 13, thereby forming a flat, rectangular vacuum envelope 10 in which a high-level vacuum of $10^{-4}$ Pa or less is maintained.

A plurality of spacers 14, which support an atmospheric pressure load acting on the front substrate 11 and back substrate 12, are provided within the vacuum envelope 10. The spacers 14 may be plate-like ones or columnar ones.

The front substrate 11 has an image display surface on its inside. Specifically, the image display surface is composed of a phosphor screen 15, a metal back layer 20 that is disposed on the phosphor screen 15, and a getter layer 22 which is an electrically conductive thin film disposed on the metal back layer 20.

The phosphor screen 15 is composed of phosphor layers 16, which emit red, green and blue lights, and a black light-blocking layer 17 which is disposed in a matrix shape. The metal back layer 20 is formed of, e.g. aluminum, and functions as an anode. The getter layer 22 is formed of a metal film with gas adsorption properties, for example, a layer of a metal selected from Ti, Zr, Hf, V, Nb, Ta, W and Ba, or a layer of an alloy consisting essentially of at least one metal selected from these metals. The getter layer 22 adsorbs a gas remaining within the vacuum envelope 10 and an emission gas from the substrates.

The back substrate 12 has surface-conduction electron emitter elements 18 on its inner surface. The electron emitter elements 18 emit electron beams for exciting the phosphor layers 16 of the phosphor screen 15 and function as electron emitter sources. Specifically, these electron emitter elements 18 are arranged on the back substrate 12 in columns and rows in association with pixels, and emit electron beams toward the phosphor layers 16. Each of the electron emitter elements 18 comprises an electron emission part and a pair of element electrodes for applying a voltage to the electron emission part, which are not shown. A great number of wiring lines 21 for supplying potential to the electron emitter elements 18 are provided in a matrix on the inner surface of the back substrate 12, and end portions of the wiring lines 21 are led out of the vacuum envelope 10.

In the FED, at the time of the operation for displaying an image, an anode voltage is applied to the image display surface including the phosphor screen 15 and the metal back layer 20. The electron beams, which are emitted from the electron emitter elements 18, are accelerated by the anode voltage and caused to strike the phosphor screen 15. Thereby, the phosphor layers 16 of the phosphor screen 15 are excited and caused to emit lights of associated colors. Thus, a color image is displayed on the image display surface.

Next, a detailed structure of the metal back layer 20 in the FED having the above-described structure is described. The term "metal back layer", in this context, refers to not only a layer of a metal, but also layers of various materials. For the purpose of convenience, the term "metal back layer" is used.

Figure 3:
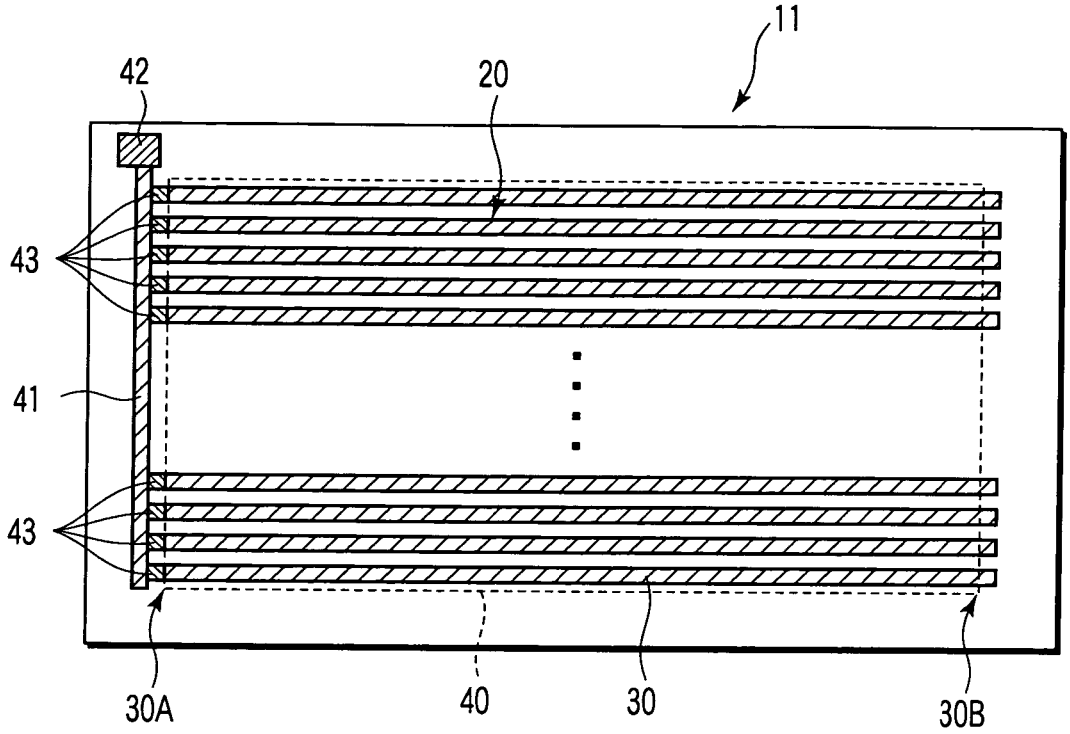
FIG. 3 is a plan view that schematically shows a structure of a front substrate of the image display device according to the embodiment of the invention.
Figure 4:
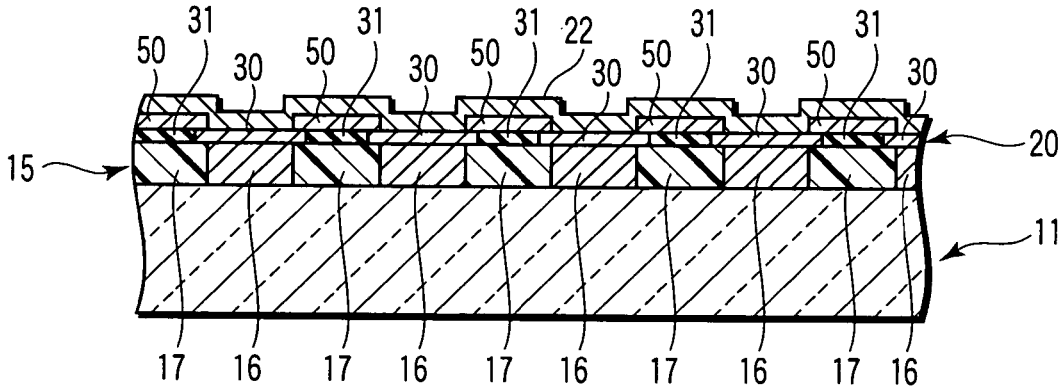
FIG. 4 is a cross-sectional view that schematically shows the structure of the front substrate shown in FIG. 3.

As is shown in FIG. 3 and FIG. 4, the phosphor screen 15 includes a great number of stripe-shaped phosphor layers 16, which emit red, blue and green lights, in an effective section 40 which substantially displays an image. These phosphor layers 16 are arranged in parallel with predetermined gaps. In the effective section 40, the phosphor screen 15 includes a great number of stripe-shaped black light-blocking layers 17. The black light-blocking layers 17 are disposed between the phosphor layers 16.

The metal back layer 20, which is superposed on the phosphor screen 15, is composed of a plurality of insular divisional electrodes 30. The divisional electrodes 30 are mainly arranged on the phosphor layer 16 and are formed in stripe shapes in association with the phosphor layers 16. With this arrangement, the metal back layer 20 is always present on the phosphor layers 16, and does not affect the luminance characteristics and degradation of the phosphors.

There are various methods for dividing the metal back layer 20. For example, when the metal back layer 20 is to be formed on the phosphor screen 15 by a thin film formation method such as vacuum evaporation, dividing members with such characteristics as to electrically divide a thin film are disposed on the black light-blocking layers 17 in advance. Thereby, the metal back layer 20 is formed and divided at the same time. In another method for dividing the metal back layer 20, a metal back layer 20 in a non-divided form is formed, and then the metal back layer 20 is divided by heat treatment using, e.g. a laser, or by applying physical pressure. In still another method for dividing the metal back layer 20, a metal film of, e.g. aluminum is formed on the phosphor layer 15, and then chemical treatment is performed such that the metal film on the black light-blocking layer 17 is baked and made into an insulative metal compound (e.g. metal oxide).

As shown in FIG. 3, the divided metal back layers 20 are disposed as strip-shaped divisional electrodes 30 which extend in a direction parallel to the direction of extension of the phosphor layers 16. The metal back layer 20, which is divided by the chemical treatment, is configured to include insulative metal compound layers 31 between the divisional electrodes 30. Specifically, the metal compound layers 31 are disposed on the black light-blocking layers 17.

With this structure, the capacitance of the image formation surface can be divided by the divided metal back layers 20, and the current flowing at a time of discharge between the front substrate 11 and back substrate 12 can be reduced. Thereby, it is possible to reduce damage due to discharge on the image formation surface including the phosphor screen 15, the electron emitter elements 18 and driving circuits.

Since the divisional electrodes 30 are independent in insular shapes, anode voltage cannot be supplied from outside to the divisional electrodes 30 in this state. Thus, a common electrode 41 is provided for supplying the anode voltage to all the divisional electrodes 30. A high voltage supply section 42 is formed at a part of the common electrode 41, and a voltage can be applied by proper means. For example, a metallic pin, which extends from a high-voltage terminal provided on the back substrate 12, may contact the high voltage supply section 42. The high voltage supply section 42 may not be provided separately, and a part of the common electrode 41 may be formed as a high voltage supply section.

The common electrode 41 is disposed on the outside of the effective section 40, and extends in a direction perpendicular to the direction of extension of each divisional electrode 30. Specifically, the common electrode 41 is formed in a stripe with a predetermined distance from each divisional electrode 30 on one end portion 30A side of the stripe-shaped divisional electrodes 30.

The common electrode 41 is formed of a material having high electrical conductivity. Preferably, the common electrode 41 should be formed by screen-printing, e.g. Ag (silver) paste. Preferably, the resistivity of the common electrode 41 should be set at about 0.1E-4 Ωcm.

If the common electrode 41 is directly connected to the divisional electrodes 30, the neighboring divisional electrodes 30 are electrically connected via the common electrode 41. Consequently, the effect of suppressing the discharge level is lost. Thus, the divisional electrodes 30 are electrically connected to the common electrode 41 via connection resistors 43.

A resistance value R2 of the connection resistor 43 is determined by totally considering the tolerance of discharge current and decrease in luminance, as well as the material characteristics of the connection resistors 43.

With this structure, the state in which the capacitance is divided by the divisional electrodes 30 is maintained. Therefore, the damage due to discharge occurring between the front substrate 11 and back substrate 12 is suppressed.

In the meantime, as shown in FIG. 4, since the getter layer 22 that is laid on the metal back layer 20 is the electrically conductive thin film, the getter layer 22 electrically connects the plural divisional electrodes 30. Thus, according to the present image display device, dividing layers 50 for electrically dividing the getter layer 22 are provided. Specifically, the dividing layers 50 divide the getter layer 22 in independent insular shapes on the black light-blocking layers 17 (or on the metal compound layers 31) so that the plural divisional electrodes 30 of the metal back layer 20 may not electrically be connected by the getter layer 22.

The dividing layers 50 have proper electrical conductivity so as not to cause charging by the incidence of electrons. Specifically, when an image is to be displayed, electrons emitted from the electron emitter elements 18 are not directly made incident on the dividing layers 50, but dispersed electrons from the phosphor layers 16 enter the dividing layers 50. If the dividing layers 50 are formed of an insulating material with no substantial electrical conductivity, the dividing layers 50 are charged with the dispersed electrons, and slight partial discharge, which leads to abnormal discharge between the substrates, may occur.

In the present image display device, electrical conductivity is imparted to the dividing layers 50. Thus, even if dispersed electrons are incident, the dividing layers 50 are prevented from being charged. A proper electrical conductivity, which is to be imparted to the dividing layers, is determined by, e.g. the amount of dispersed electrons, and a voltage threshold value at which minute partial discharge occurs due to charging.

Preferably, the dividing layers 50 should be formed of a material with a sheet resistance of 1E12 Ω/□ or less. If the dividing layers 50 have a sheet resistance higher than 1E12 Ω/□, it is difficult to suppress charging of the dividing layers 50, and an adequate discharge prevention effect cannot be obtained. In short, it is difficult to sufficiently improve withstand voltage characteristics.

On the other hand, the dividing layers 50 should preferably be formed of a material with a sheet resistance of 1E5 Ω/□ or more. If the dividing layers 50 have a sheet resistance less than 1E5 Ω/□, neighboring divisional electrodes 30 are electrically connected via the dividing layers 50, and it is not possible to obtain a sufficient effect of division of the capacitance of the image formation surface, which is realized by dividing the metal back layer 20. In short, the effect of reducing the damage due to discharge cannot fully be obtained.

With the provision of the dividing layers 50 having the proper electrical conductivity, the occurrence of discharge due to charging of the dividing layers 50 can be suppressed, and the withstand voltage characteristics can be improved. It is thus possible to prevent damage and degradation due to discharge on the electron emitter elements and phosphor screen. Moreover, display with high luminance and high image quality can be realized.

The dividing layers 50 can be formed, for example, by screen-printing a dividing layer material with a predetermined pattern on the metal back layer 20. Regions where the pattern of the dividing layer material is formed are set, for example, at regions over the black light-blocking layers 17. In the case where the dividing layers 50 are formed with the pattern on the regions excluding regions over the phosphor layers 16, a decrease in luminance due to absorption of electron beams by the dividing layers 50 is advantageously small.

An average grain size of fine particles of the dividing layer material should preferably be set at 5 nm to 30 μm, and more preferably at 10 nm to 10 μm. If the average grain size of fine particles is less than 5 nm, unevenness of the dividing layer surface is substantially eliminated (i.e. high planarity) and a getter material (getter layer), which is formed by a vacuum process, is provided without discontinuity on the dividing layers. It is thus not possible to form many independent insular getter layers. If the average grain size of fine particles exceeds 30 μm, the formation itself of the dividing layers 50 is disabled.

Figure 5:
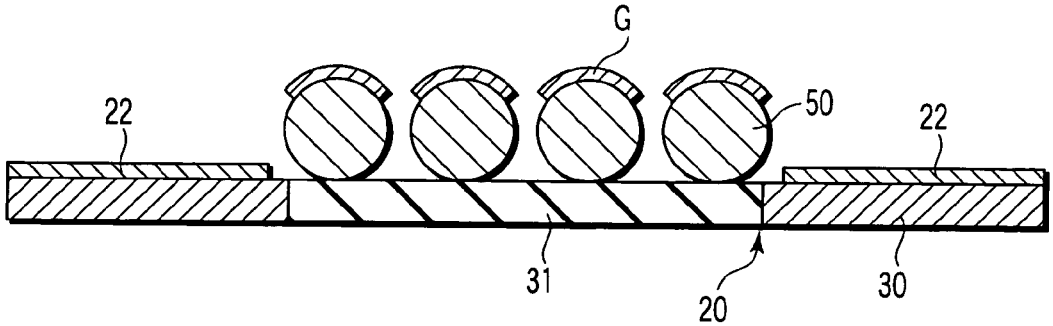
FIG. 5 schematically shows a cross-sectional structure of a part in the vicinity of a divining layer of the front substrate shown in FIG. 4.

The front substrate 11 having the dividing layers 50 and the back substrate 12 are vacuum-sealed by means of frit glass, etc., and the vacuum envelope 10 is formed. Then, a getter material is formed on the pattern of the dividing layers 50 within the vacuum envelope 10 by a vacuum process. Thus, the getter layers 22, which are divided on the dividing layers 50, can be formed. Specifically, the getter material is formed as a continuous film on regions of the metal back layer 20, where the pattern of the dividing layers 50 is not formed, that is, on regions over the divisional electrodes 30, and the getter layer 22 is formed. On the other hand, as shown in FIG. 5, a getter material G is not formed as a continuous film on the dividing layers 50, and the getter material G is electrically disconnected from the getter layer 22 on the divisional electrode 30. Hence, getter layers 22, which are divided in insular shapes, can be formed.

As has been described above, according to the image display device of this embodiment, the dividing layers have proper electrical conductivity, and the charging of each dividing layer itself can be prevented, and the withstand voltage characteristics can be improved. Accordingly, damage and degradation due to discharge on the electron emitter elements and phosphor screen can be prevented. Moreover, display with high luminance and high image quality can be realized.

In another embodiment, an electrically conductive layer (hereinafter referred to as "dividing-part conductive layer") may be disposed on an upper surface of the dividing layer 50 which divides the getter layer 22 that is the electrically conductive thin film, or between the dividing layer 50 and the insulative metal compound layer 31. In other words, the dividing-part conductive layer may be disposed on the dividing layer 50.

Figure 6:
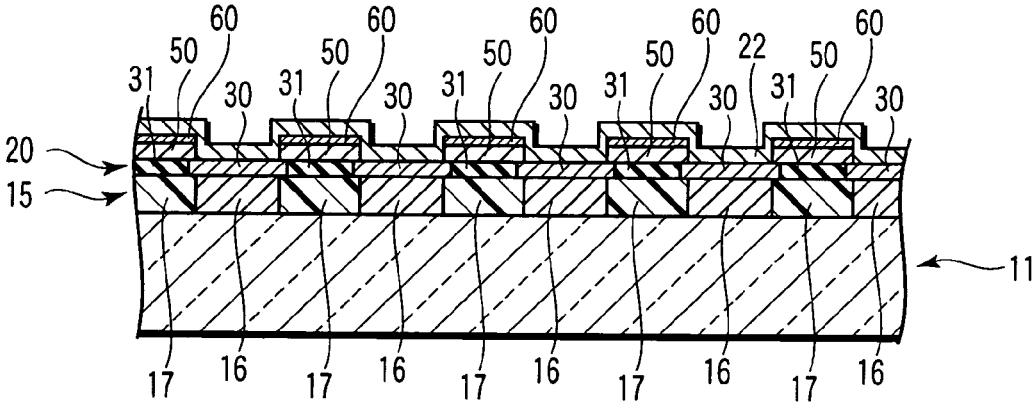
FIG. 6 is a cross-sectional view that schematically shows another structure of the front substrate shown in FIG. 3.

As shown in FIG. 6, in the case where the dividing-part conductive layers 60 are disposed on upper surfaces of the dividing layers 50 (i.e. the dividing-part conductive layers 60 are disposed between the dividing layers 50 and the getter layers), the dividing-part conductive layers 60 need to be formed so that the function of the dividing layers 50 for dividing the getter layer 22 into many independent insular parts may not be lost. For example, the dividing-part conductive layers 60 should preferably be formed of thin layers which do not affect the unevenness of the dividing layers 50.

Figure 7:
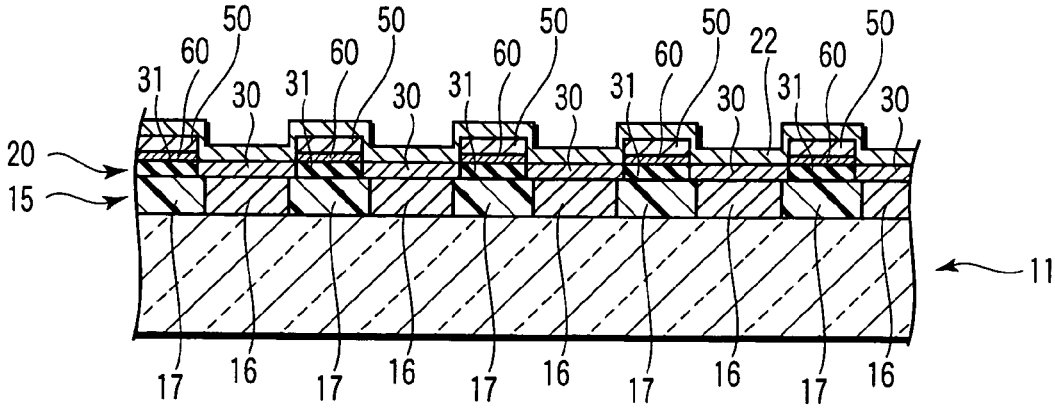
FIG. 7 is a cross-sectional view that schematically shows still another structure of the front substrate shown in FIG. 3.

As shown in FIG. 7, in the case where the diving-part conductive layers 60 are disposed between the dividing layers 50 and the metal compound layers 31, the distance between the electron incidence region and the diving-part conductive layers 60 needs to be reduced so as not to cause charging due to the incidence of electrons on the dividing layers 50. This distance is determined by the electron incidence amount and the electron incidence angle.

The diving-part conductive layers 60 are formed of an electrically conductive material with proper electrical conductivity. Specifically, the sheet resistance value of the diving-part conductive layers 60 is determined in a range that is defined by a value at which the dividing layers 50 are not charged, and a value at which the discharge suppression effect is not lost by electrical conduction between the neighboring divisional electrodes. In other words, as described in connection with the foregoing embodiment, the dividing-part conductive layers should preferably have a sheet resistance in a range between 1E5 Ω/□ and 1E12 Ω/□.

As has been described above, since the diving-part conductive layers 60 having proper electrical conductivity are provided in contact with the dividing layers 50, the charging of the dividing layers 50 can be suppressed by the diving-part conductive layers 60 even if the dividing layers 50 have no electrical conductivity. Moreover, since the dividing layers 50 can be formed as electrical insulators, it is possible to obtain the structure with good getter layer division characteristics (i.e. the getter layer 22 can exactly be electrically divided).

The present invention is not limited to the above-described embodiments. At the stage of practicing the invention, various embodiments may be made by modifying the structural elements without departing from the spirit of the invention. Structural elements disclosed in the embodiments may properly be combined, and various inventions may be made. For example, some structural elements may be omitted from the embodiments. Moreover, structural elements in different embodiments may properly be combined.

The present invention can provide an image display device which can suppress damage due to discharge, and improve withstand voltage characteristics and display performance.

What is claimed is:

1. An image display device comprising:

a front substrate having a phosphor screen which includes a phosphor layer and a light-blocking layer, a metal back layer which is laid over the phosphor screen and is composed of a plurality of strip-shaped divisional electrodes, an electrically conductive thin film which is laid over the metal back layer, and a dividing layer which electrically divides the electrically conductive thin film over the light-blocking layer; and a back substrate which is disposed to be opposed to the front substrate and is provided with electron emitter elements which emit electrons toward the phosphor screen, wherein the dividing layer has electrical conductivity.

2. The image display device according to claim 1, wherein the dividing layer has a sheet resistance of 1E12 Ω/□ or less.

3. The image display device according to claim 1, wherein the dividing layer has a sheet resistance of 1E5 Ω/□ or more.

4. The image display device according to claim 1, wherein the electrically conductive thin film is a layer of a metal selected from Ti, Zr, Hf, V, Nb, Ta, W and Ba, or a layer of an alloy consisting essentially of at least one metal selected from Ti, Zr, Hf, V, Nb, Ta, W and Ba.

5. An image display device comprising:

a front substrate having a phosphor screen which includes a phosphor layer and a light-blocking layer, a metal back layer which is laid over the phosphor screen and is composed of a plurality of strip-shaped divisional electrodes, an electrically conductive thin film which is laid over the metal back layer, a dividing layer which electrically divides the electrically conductive thin film over the light-blocking layer, and a dividing-part conductive layer which is laid over the dividing layer; and a back substrate which is disposed to be opposed to the front substrate and is provided with electron emitter elements which emit electrons toward the phosphor screen, wherein the dividing-part conductive layer has electrical conductivity.

6. The image display device according to claim 5, wherein the dividing-part conductive layer has a sheet resistance of 1E12 Ω/□ or less.

7. The image display device according to claim 5, wherein the dividing-part conductive layer has a sheet resistance of 1E5 Ω/□ or more.

* * * * *